United States Patent [19]

Mason

[11] 4,291,556

[45] Sep. 29, 1981

[54] AUTOMATIC WASHER TRANSMISSION SHIFT MECHANISM

[75] Inventor: Anthony Mason, Lincoln Township, Berrien County, Mich.

[73] Assignee: Whirlpool Corporation, Benton Harbor, Mich.

[21] Appl. No.: 35,935

[22] Filed: May 4, 1979

[51] Int. Cl.[3] ..... D06F 23/04; D06F 37/40

[52] U.S. Cl. ..... 68/23.7; 68/133; 192/89 A; 192/93 A

[58] Field of Search ..... 68/23.6, 23.7, 133; 192/89 A, 93 A

[56] References Cited

U.S. PATENT DOCUMENTS

| | | | |
|---|---|---|---|
| 962,567 | 6/1910 | Hancock | 192/101 |
| 2,060,175 | 11/1936 | Carleton | 192/24 |
| 2,269,190 | 1/1942 | Dunham | 68/23.6 |
| 2,388,407 | 11/1945 | Hansen | 192/101 |
| 2,720,953 | 10/1955 | Dayton | 192/3.61 |
| 2,826,056 | 3/1958 | Bruckman | 68/23.7 |
| 2,976,746 | 3/1961 | Flannery | 68/23.7 X |
| 3,204,131 | 8/1965 | Wright, Jr. | 307/112 |

*Primary Examiner*—Philip R. Coe

*Attorney, Agent, or Firm*—Hill, Van Santen, Steadman, Chiara & Simpson

[57] ABSTRACT

A transmission shift mechanism for use in a vertical axis automatic washing machine having reversible rotary drive means has a drive gear on which is mounted an eccentric for translating rotary motion into oscillatory motion in a plane perpendicular to the washing machine axis. The oscillatory motion is transmitted to the agitator shaft of a washing machine by a rack and pinion. The pinion is rotatably mounted on the agitator shaft and has teeth on a lower surface thereof which engage teeth on an upper surface of a sleeve co-rotatable with the agitator shaft to form a jaw clutch for driving the agitator shaft from the rack and pinion. A shifter fork also connected to the eccentric operates cams to raise the pinion out of engagement with the sleeve to disengage the jaw clutch when the eccentric is rotating in a first direction, and returns the clutch teeth to engagement when the eccentric rotates in an opposite direction.

9 Claims, 9 Drawing Figures

22

30
31
34
107
40
21
41
26
19
25
35
36
43a
III
50
87
81
51
92
43
52
70
73
56
77
37
33
35
43a
III
32
42
23

FIG. 3
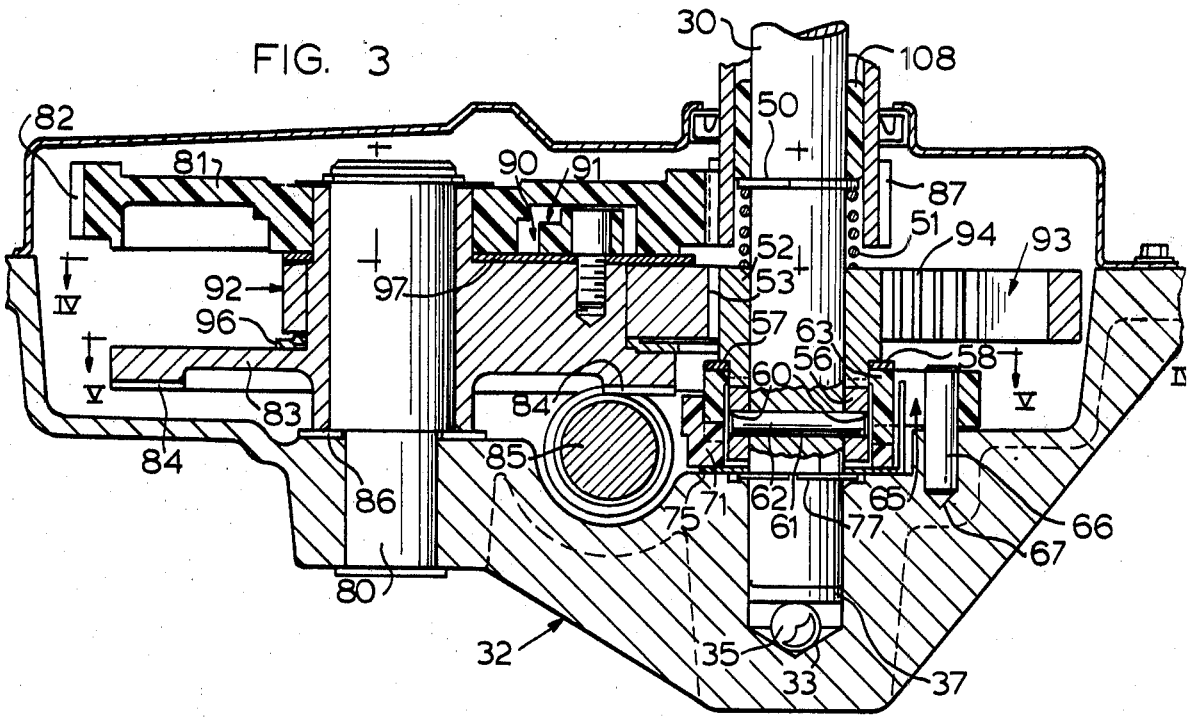
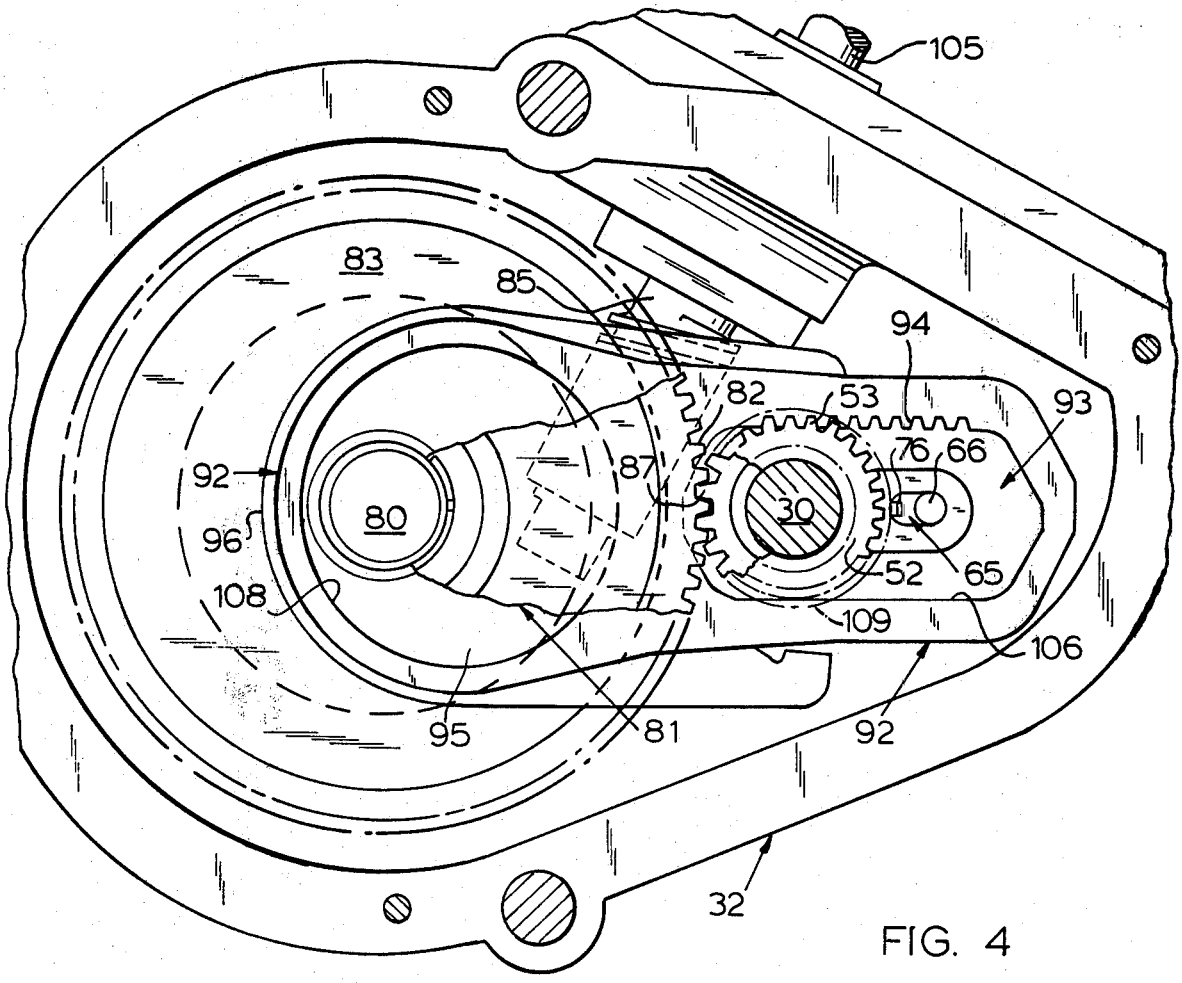
FIG. 4

AUTOMATIC WASHER TRANSMISSION SHIFT MECHANISM

BACKGROUND OF THE INVENTION

1. Field of the Invention

The present invention relates to a drive mechanism and transmission for an automatic washer of the type in which clothes are washed by oscillation of a vertical agitator and subsequently have water centrifugally removed therefrom by high speed rotation of a wash basket.

2. Description of the Prior Art

Automatic laundry appliances having a pre-selected programmed cycle of operation which includes a washing period during which oscillation of an agitator imparts a movement to clothes enclosed in a wash basket and a water removal period during which the wash basket is rotated at a high speed are known in the art. It is also known in the art to operate the components of the machine during different periods of the cycle by a common drive means. When a single drive means is utilized, it is necessary to provide a transmission having a shift means which can be operated to selectively condition the drive means to supply oscillatory motion to the agitator, or to supply rotational motion to the wash basket.

It is known in the art to impart oscillatory motion to a vertical agitator by means of a lever connected to an eccentric and a segmental gear which engages a circular gear co-rotational with the agitator axis.

SUMMARY OF THE INVENTION

A transmission shift mechanism for a vertical axis oscillating agitator laundry appliance has a rotating drive gear on which is mounted an eccentric. The eccentric rotates in a circular aperture in one end of a rack, thereby imparting oscillatory motion to the rack in a plane perpendicular to the agitator axis. The opposite end of the rack has a loop which surrounds the agitator shaft and has teeth thereon which engage teeth carried on the circumference of a pinion which is rotatably mounted on the agitator shaft. The pinion has a second set of teeth formed on a bottom surface thereof which engage teeth carried on the upper surface of a sleeve co-rotatable with the agitator shaft to form a jaw clutch. The oscillatory motion imparted to the pinion by the rack may thereby be transferred to the sleeve to oscillate the agitator shaft.

A cam means for engaging and disengaging the jaw clutch comprises a pair of collars having engageable cam ramp surfaces disposed below a portion of the pinion and surrounding the sleeve which is co-rotatable with the agitator axis. The upper collar is maintained in a rotationally stationary position while the agitator shaft oscillates inside of it.

The lower collar carries two upwardly extending projections about its exterior, and is rotatable by abutment against the projections of two tynes carried on an end of an eccentrically controlled shifter fork. Rotation of the eccentric in one direction will cause one of the tynes on the shifter fork to abut one of the projections on the lower collar. The ramps of the cam surfaces are coordinated with the direction of rotation of the eccentric such that movement of the eccentric in a first direction will cause a first tyne to abut a projection to rotate the lower collar to move the ramps out of engagement and raise the upper collar, thereby raising the pinion and disengaging the teeth of the jaw clutch. Rotation of the eccentric in an opposite direction causes the other of the tynes on the shifter fork to abut the other projection on the lower collar, rotating the lower collar to reengage the cam ramp surfaces, thereby allowing reengagement of the jaw clutch pinion teeth with the teeth on the sleeve.

BRIEF DESCRIPTION OF THE DRAWINGS

FIG. 3 is a cross-sectional view taken along line III—III of FIG. 2.

FIG. 4 is a view taken along line IV—IV of FIG. 3.

DESCRIPTION OF THE PREFERRED EMBODIMENTS

Figure 1:
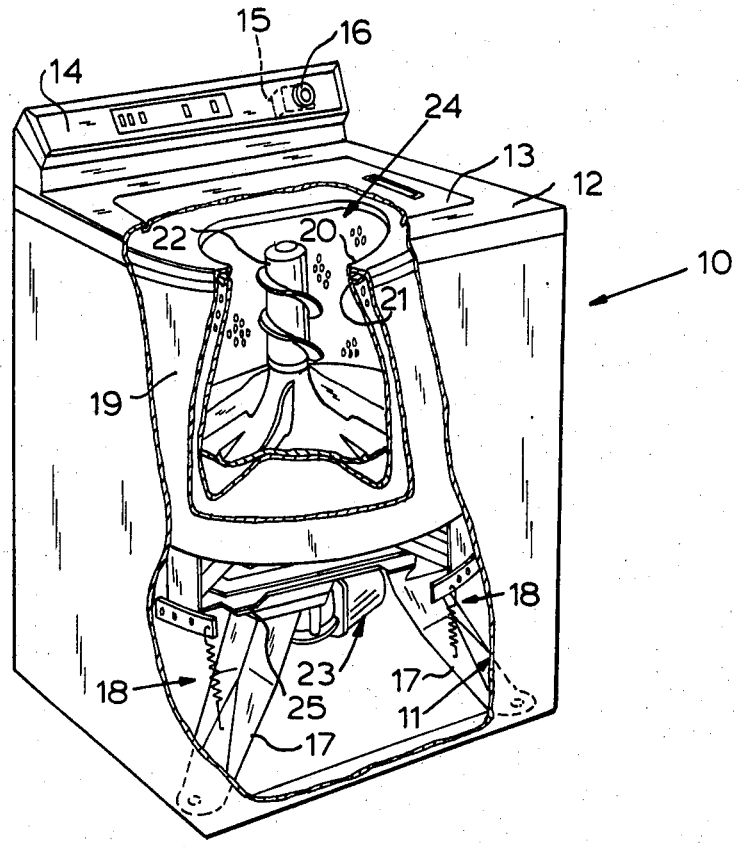
FIG. 1 is a perspective view, partly broken away, of a vertical axis laundry appliance.

An automatic laundry appliance is generally illustrated in FIG. 1 at 10 as comprising a tub 19 which has a perforate clothes container or spin basket 21 contained therein and an agitator 22 vertically disposed within the spin basket 21, mounted for oscillatory movement with respect thereto. The basket 21 is mounted for spinning movement during centrifugal extraction of water from the clothes within the basket 21. The tub 19, the spin basket 21, the agitator 22 and a drive mechanism 23 therefor are contained in a cabinet 11.

The cabinet 11 has a top 12 having a hinged lid 13 which is opened to afford access to a clothes-receiving opening 24 which is defined by a tub ring 20 extending about the tub and over a corresponding opening in the spin basket 21. The cabinet 11 also includes a program controller including a timer dial 16 connected to a timer 15 which is mounted on a control panel portion 14 of the cabinet 11. Suitable wiring connects the timer 15 to the drive mechanism 23 and to other electrical components of the appliance to control operation of a wash cycle as is well known in the art. The program controller provides the washing appliance with a sequence of events including agitating the clothes load in a washing portion, spinning the clothes load in the basket 21 to centrifuge the washing liquid therefrom, agitating the clothes load in a rinsing portion, and spinning the clothes load in the basket 21 to centrifuge the rinsing liquid therefrom. The timer dial 16 and the timer 15 may be mounted in any desired location and are shown in the present location for illustrative purposes only.

Figure 2:
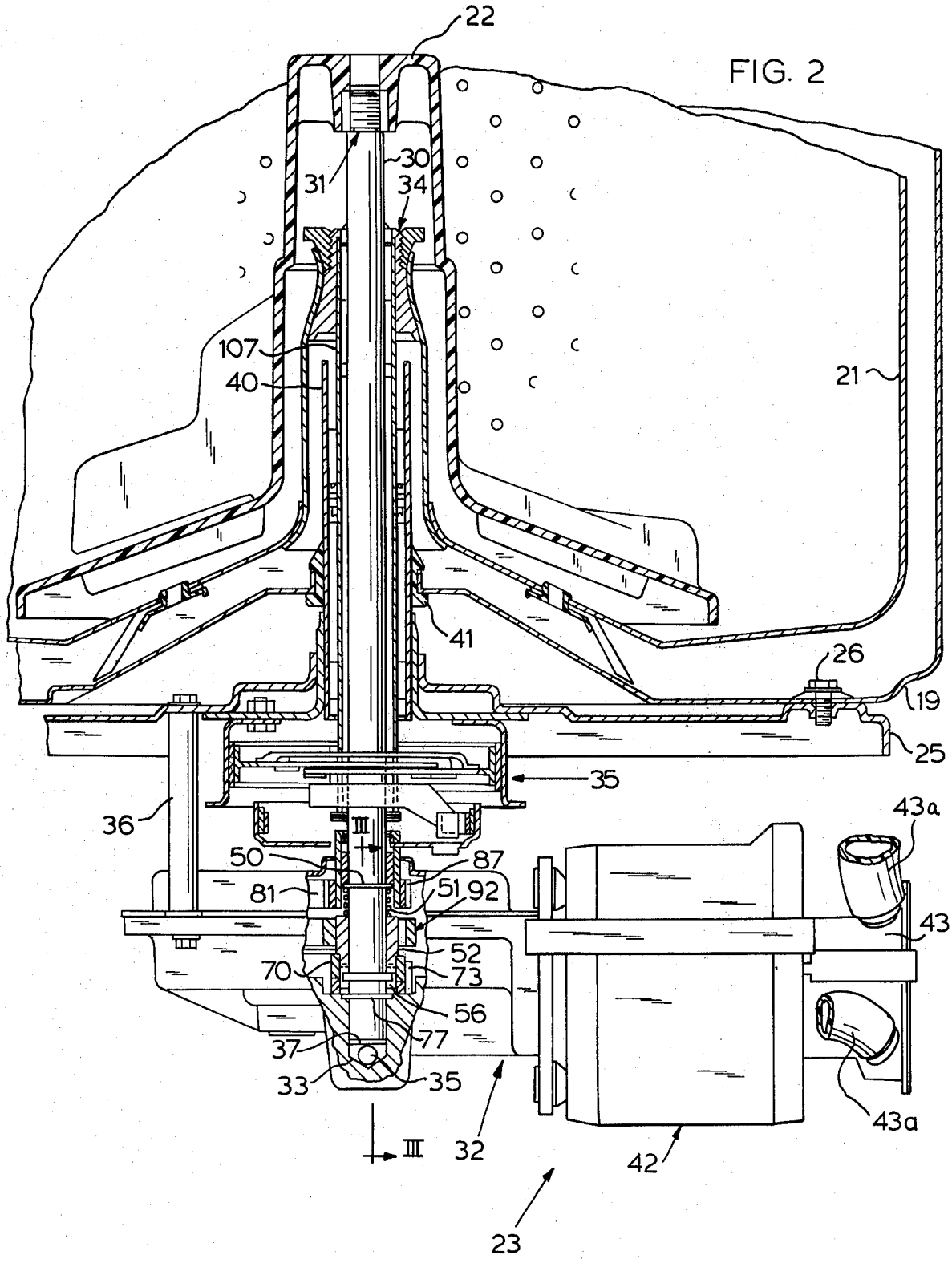
FIG. 2 is a detailed sectional view of the wash basket, agitator and associated drive means of the laundry appliance of FIG. 1.

All components inside the cabinet 11 are supported by struts 17, having a suspension system 18 connected thereto to minimize vibration. Referring to FIG. 2, the drive mechanism 23 also operates a pump 43. The drive mechanism 23, and other components such as a transmission housing 32 and a motor housing 42, are suspended from a mounting plate 25 by mounting means such as a bolt and sleeve arrangement 36. Portions of hoses 43*a* associated with the pump are also illustrated in FIG. 2. The tub 19 is also mounted to the mounting plate 25 by means of bolts such as 26. A grommet 41 maintains a water-tight relationship between the tub 19 and an agitator encasement column 40. A brake means 35 is also provided to operate in association with a spin tube 107 and an agitator shaft 30, and has a dish shaped member mounted to the mounting plate 25.

The agitator 22 is attached to the agitator shaft 30 by threaded means 31 and the spin basket 21 is attached to the spin tube 107 by threaded drive block means 34.

Figure 6:
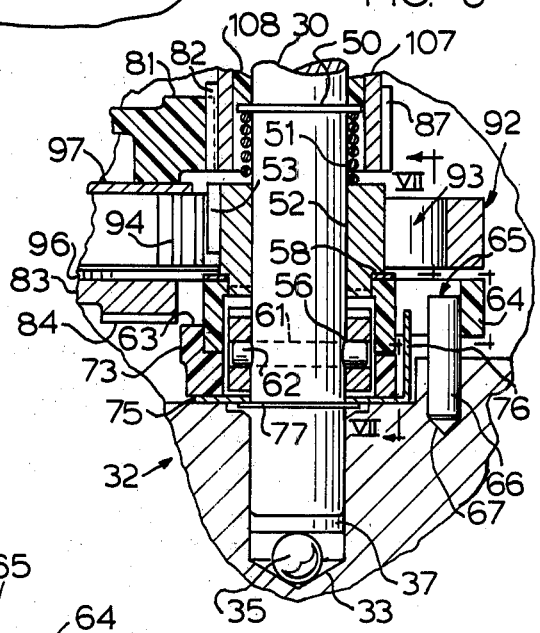
FIG. 6 is a detailed sectional view of the clutch mechanism shown in FIG. 3.
Figure 9:
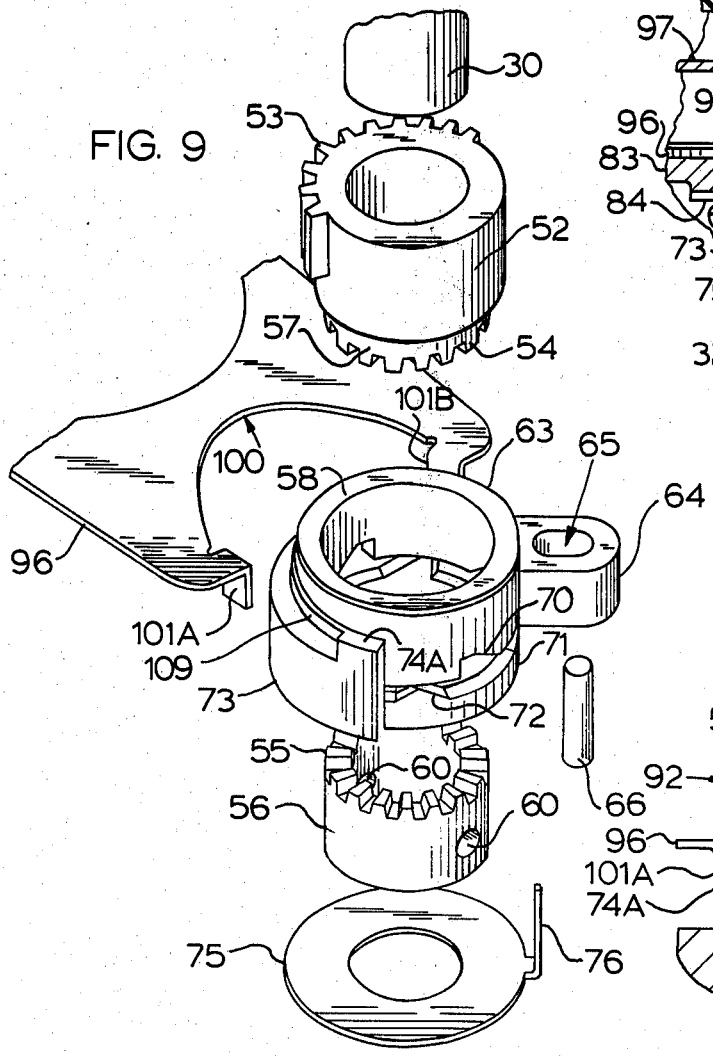
FIG. 9 is an exploded view of the clutch mechanism of FIG. 3.
Figure 7:
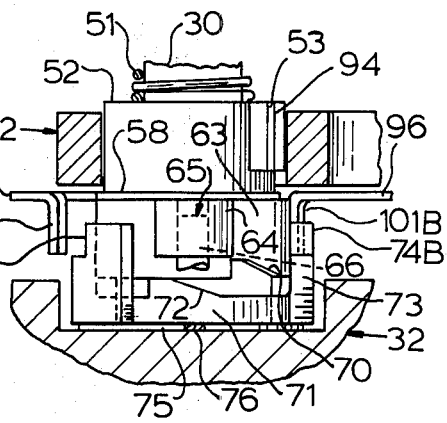
FIG. 7 is a view taken along line VII—VII of FIG. 6.

The shifting mechanism is shown in detail sectional views in FIGS. 3, 6 and 7, and in an exploded view in FIG. 9. The agitator shaft 30 extends into a receptacle 33 in the housing 32 and rests on a bearing plate 37 and a bearing 35 allowing rotation of the shaft 30 about its central vertical axis with a minimum of friction.

Oscillatory movement is imparted to the agitator shaft 30 as follows. As shown in FIGS. 3 and 4, a worm gear 85 is attached to a drive shaft 105 journaled in transmission housing 32 and driven by a motor contained in the housing 42 (FIG. 2). The worm 85 engages teeth 84 on a main drive gear 83, thereby imparting rotational movement to the drive gear 83 about a jack shaft 80. A washer 86 reduces friction between the housing 32 and the drive gear 83. An eccentric 95 is integrally formed on an upper portion of the main drive gear 83. The jack shaft 80 and the agitator 30 are parallel to each other, and a rack shown generally at 92 is disposed in a plane normal to the shafts.

The rack 92 has a circular aperture 108 at one end thereof which receives eccentric 95. An opposite end of the rack 92 has a loop 93 which surrounds the agitator shaft 30. A row of teeth 94 are carried on one side of the loop 93 and engage teeth 53 which are carried on a portion of the exterior of a pinion 52 which rotates freely about the agitator shaft 30. The side of the loop 93 opposite the teeth 94 has a smooth bearing surface 106 which moves against a portion of the exterior of the pinion 52 which has no teeth thereon, thereby insuring complete engagement of the teeth 53 on the pinion 52 and the teeth 94 on the rack 92. As the eccentric 95 is rotated by the main gear 83, a reciprocal motion in a plane normal to the agitator shaft 30 is imparted to the rack 92. This reciprocatory motion is transferred to the pinion 52 by means of engagement of the teeth 94 and 53. Oscillatory motion is thus transferred to the pinion 52. This motion is then transferred to the agitator shaft 30 through a jaw clutch means described below.

The pinion 52 has a second set of teeth 54 integrally formed on a lower portion and disposed downwardly to form the driving member of the jaw clutch. (See FIG. 9). The circumference of the lower toothed portion of pinion 52 is slightly less than the circumference of the main portion of the pinion, thereby forming an annular ledge 57 which is normal to the agitator shaft 30. The teeth 54 on the pinion 52 are arranged to engage similar teeth 55 carried on an upper surface of a sleeve or driven member 56 of the jaw clutch. The sleeve 56 has holes 60 (FIG. 9) disposed in the side walls thereof, which receive a pin 62. The pin 62 also passes through a bore 61 disposed in the agitator shaft 30. Insertion of the pin 62 in the holes 60 and the bore 61 maintains the sleeve 56 in co-rotatable relation to the agitator shaft 30. Although the pinion 52 is free to rotate about the agitator shaft 30, when the teeth 54 and 55 are engaged, the oscillatory motion of the pinion 52 is transferred to the sleeve 56 so that the motion is in turn transferred to the agitator shaft 30.

As shown in FIG. 6, the teeth 54 and 55 are maintained in engagement by means of a biasing spring 51 which abuts an upper surface of the pinion 52. An upper portion of the spring 51 bears against a snap ring 50 which is maintained in position by being placed in a circumferential groove (not shown) in the agitator shaft 30.

It is desired to maintain the jaw clutch teeth 54 and 55 in engagement only during the agitate portion of the laundry appliance cycle to oscillate the agitator 22, and to disengage the teeth 54 and 55 during a spin portion of the cycle so that the agitator is free to rotate with the spin basket 21. When this sequence of events is repeated, it is then desirable to re-engage the teeth 54 and 55 to allow the oscillatory motion of the agitator to again result. Referring to FIGS. 6, 7 and 9, engagement and disengagement of the teeth 54 and 55 is accomplished by cam means including a pair of collars 63 and 71, disposed between the pinion 52 and a base washer 75 and also surrounding the agitator shaft 30 and sleeve 56. The upper collar 63 has a plurality of downwardly extending cam ramp surfaces 70, and the lower collar 71 has the same number, for example three, upwardly extending mating cam ramp surfaces 72. Both collars 63 and 71 are free to rotate about the agitator shaft 30. The upper collar 63 is maintained in a rotationally stationary position relative to the agitator shaft 30 by means of a radially protruding anchor 64 which has a hole 65 vertically disposed therein. A stud 66 inserted into a hole 65 and extending into a receptacle 67 in the housing 32 allows limited vertical motion of the upper cam member 63 in relation to the agitator shaft 30, but prevents rotational movement relative thereto. A vertical pin 76 extending from the base washer 75 also extends into the hole 65 in the anchor 64 so that rotation of the base washer 75 is also prevented.

The lower collar 71 has an exterior portion 73, with two upwardly extending lugs 74A and 74B mounted thereon approximately 140° apart. A thin wall web member 109 extends between the lugs 74A and 74B to prevent interference between a shifter fork 96 and upper collar 63. An appropriate force imparted to the lugs 74A and 74B will thus rotate the lower collar 71 in an appropriate direction to effect engagement or disengagement of the cam ramp surfaces 70 and 72. When the cam ramp surfaces 70 and 72 are disengaged, the upper cam member 63 is raised the height of the cam ramp surface 72 and pushes against the surface 57 on the pinion 52 through a washer 58, thereby raising the pinion by an identical distance to disengage the jaw clutch teeth 54 and 55. The spring 51 is compressed slightly to allow such movement.

The appropriate force to rotate the lower collar 71 is applied to the lugs 74A and 74B by the shifter fork 96. The shifter fork 96 is operated by the eccentric 95 and is located between the rack 92 and the main drive gear 82 (see FIGS. 3 and 4). A recess 100 is provided at one end of the shifter fork 96, so that the shifter fork 96 may partially surround the upper collar 63. A pair of tynes 101A and 101B extend downwardly from the shifter 96 and are arranged to abut lugs 74A and 74B respectively.

Figure 8:
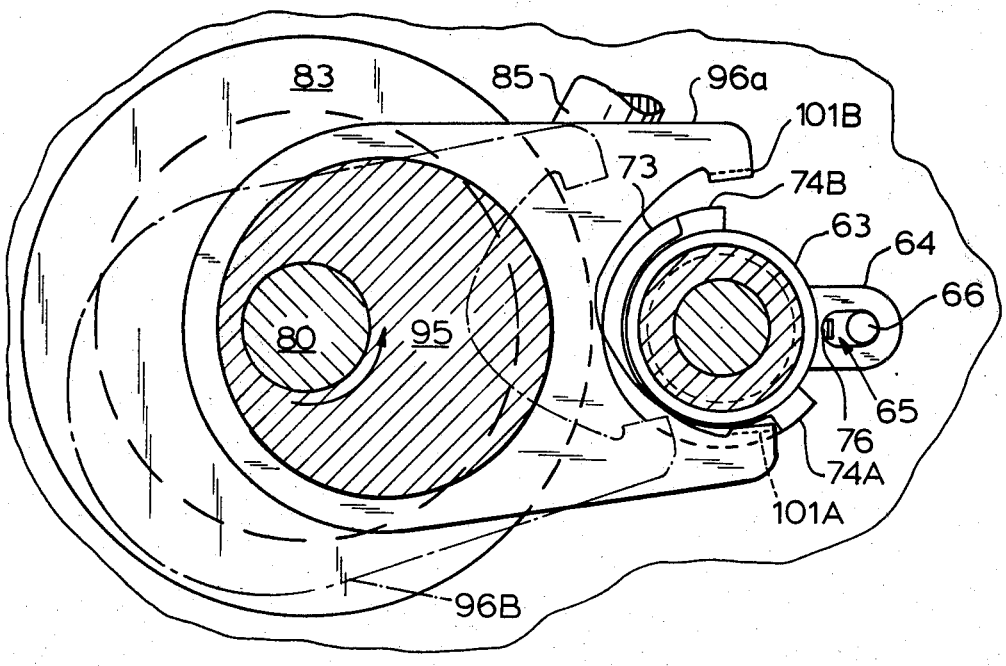
FIG. 8 is a schematic view of the shifter mechanism of FIG. 3 showing the shifter fork in various positions during the cycle of operation.
Figure 5:
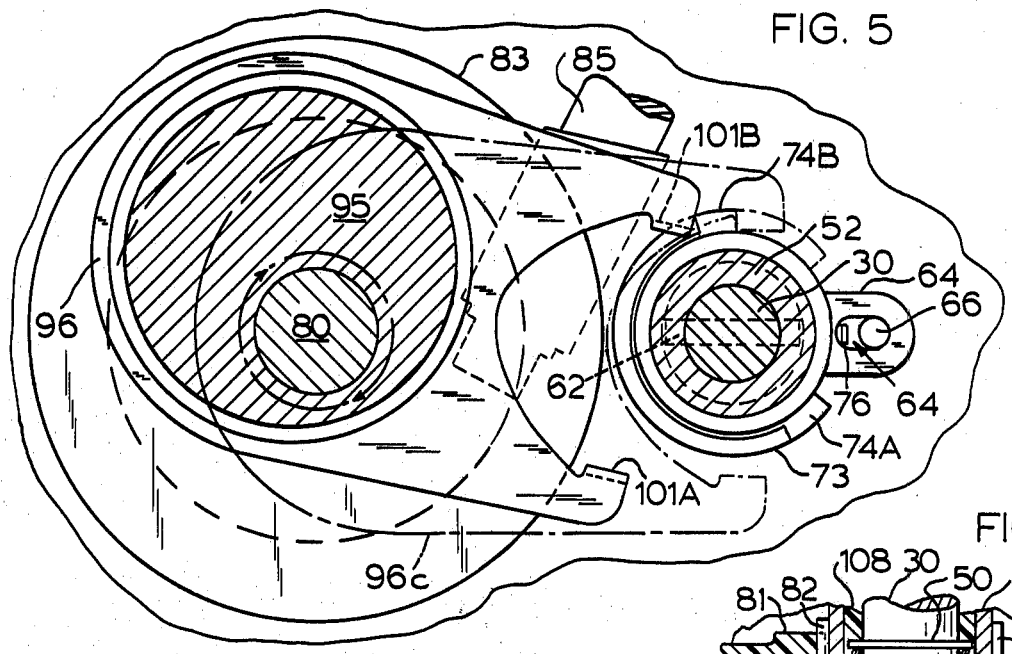
FIG. 5 is a view taken along line V—V of FIG. 3.

Operation of the shifter fork is demonstrated in FIGS. 5 and 8. The position of the tynes 101A and 101B with respect to the lower collar 71 is determined by the direction of rotation of the eccentric 95. The shifter fork 96 is acted upon by the frictional drag forces created between the shifter fork 96, the rack 92, the upper surface of the drive gear 83 and the outer peripheral surface of the eccentric 95.

The positioning of the shifter fork 96 during the agitate portion of a wash cycle is shown in FIG. 5. The drive gear 83 is being driven in a clockwise direction by the worm 85. The shifter fork 96 will thus be moved between positions shown by solid line 96 and dashed line 96C, so that the tyne 101B abuts against the lug 74B. The lower cam member 71 will thus be rotated in a clockwise direction so that the cam ramp surfaces 70 and 72 will be driven into mating engagement, and there will be no space between the lower collar 71 and the upper collar 63. Thus, the teeth 54 on the pinion 52 and the teeth 55 on the sleeve 56 will be driven into engagement under the influence of biasing spring 51. The oscillatory motion of the pinion 52 will therefore be transferred to the agitator shaft 30, so that the agitator 22 will oscillate in the tub 20.

When the main gear 83 is rotated in a counter-clockwise direction for the spin portion of the cycle, as shown in FIG. 8, the shifter fork 96 will be changed from the position shown in FIG. 5 to the position shown by the dashed line 96B, and the solid line 96A. The tyne 101A will abut the lug 74A imparting a limited counter-clockwise rotation to the lower cam member 71 as the eccentric 95 rotates, thereby disengaging the cam ramp surfaces 70 and 72 as shown in FIG. 7. The upper cam member 63 will thus be raised a height equal to the height of the ramp surface 72. The upper collar 63 abuts the washer 58 and thus the surface 57 on the pinion 52 so that the pinion 52 is also raised as identical height so that the teeth 54 and 55 are disengaged. The spring 51 is compressed slightly to allow this change in position.

During both clockwise and counter-clockwise rotation of the main drive gear 83, the tynes 101A and 101B extend a sufficient distance toward agitate shaft 30 to prevent complete disengagement of the shifter fork 96 away from the shaft.

During the spin portion of the cycle, spin basket 21 will be driven by a spin gear 81 having teeth 82 about the circumference which engage teeth 87 carried on a spin collar 107. Rotation of the spin collar 107 causes operation of the spin clutch and basket brake mechanism to effect rotation of the clothes basket 21. A delay means, shown generally at 91 in FIG. 3 is disposed in an annular groove 90 in the lower portion of the spin gear 81 to insure that the spin gear 81 will not be engaged to begin rotation of the basket 21 until a complete revolution of the main gear 83 in the counter-clockwise direction has occurred. One revolution is sufficient to insure that the shifter fork 96 will have changed from the position in FIG. 5 to the position in FIG. 8 and that the lower collar 71 will have rotated in the appropriate direction to disengage the teeth 54 and 55. The program control means through timer 15 provides the signal necessary to reverse the direction of the motor between the spin and agitate portions of the wash cycle. It will be understood that the scope of the cam ramp surfaces 70 and 72 is determined by the direction of the rotation of the main gear 83 during various portions of the wash cycle. The direction of the slope shown in the various figures is coordinated with a clockwise main gear rotation during the agitate portion of the cycle, and a counter-clockwise rotation of the main gear 83 during a spin portion of the cycle. If the directions were reversed, the slopes of the ramps 70 and 72 need only be reversed to accomplish engagement and disengagement.

Although various modifications and changes may be apparent to those skilled in the art, applicant intends to include within the patent warranted hereon all such changes and modifications as may reasonably and properly be included within the scope of applicant's contribution to the art.

The embodiments of the invention in which an exclusive property or privilege is claimed are defined as follows:

1. In an automatic laundry appliance having a reversible rotary drive means, eccentric means providing an eccentric motion for translating rotary motion of said drive means into oscillatory motion, and a clutch means for transmitting and oscillatory motion to an agitation means extending into a wash tub, a shifter means for said clutch comprising:

means operable to cause engagement and disengagement of said clutch means; and control means mounted on and driven by said eccentric means for eccentric motion therewith, said control means responsive to a change in direction of rotation of said reversible rotary drive means to operate said means operable to cause engagement and disengagement of said clutch means when a change in direction of rotation of said rotary drive means occurs.

2. In a vertical axis automatic laundry appliance having a reversible rotary drive means, the improvement of:

an eccentrically driven rack for translating rotary motion of said drive means into oscillatory motion;

a pinion slidably mounted around a vertical agitator shaft and normally spring-biased into engagement with a sleeve co-rotatable with said shaft;

said rack having a loop completely surrounding said pinion and shaft and engageable with said pinion to oscillate said shaft when said pinion and said sleeve are engaged;

means operable to cause engagement and disengagement of said pinion and collar; and control means mounted on said eccentric which is responsive to a change in direction of rotation of said reversible rotary drive means to operate said means causing engagement and disengagement of said pinion and said sleeve when a change in direction of rotation of said rotary drive means occurs.

3. In an automatic laundry appliance having a washing tub, an agitator within said tub, and a reversible motor for driving said agitator, a transmission interconnected between said agitator and said motor comprising:

an eccentric integrally mounted on a driving gear, said eccentric connected to and operating a rack and pinion for changing the rotary motion of said motor into an oscillatory motion of said pinion;

a clutch means for drivingly connecting said pinion to said agitator;

a cam means operable to engage and disengage said clutch means; and a shifter fork having a hole at one end to receive said eccentric and engagement means at another end for engagement with said cam means, said shifter fork disposed in a plane normal to said agitator and adjacent said driving gear such that a change in direction of rotation of said drive gear frictionally shifts said shifter fork to operate said cam means to disengage and engage said clutch means.

4. In an automatic laundry appliance having a washing tub, an agitator within said tub, and a reversible motor for driving said agitator, a transmission interconnected between said agitator and said motor comprising:

a main driving gear driven by said motor in selected first and second directions of rotation;

an eccentric integrally formed on one side of said driving gear;

a rack having a hole at one end which receives said eccentric and is coordinated for relative movement therewith;

a pinion connected to another end of said rack such that rotational motion imparted to said driving gear by said motor is translated into oscillatory motion by said eccentric and said oscillatory motion is transferred to said pinion by said rack;

a jaw clutch having a driving member integrally formed on a lower portion of said pinion and vertically movable into and out of engagement with a driven member which is co-rotational with said agitator, said pinion having an annular ledge encircling said driving member and disposed in a plane normal to said agitator;

a bias means normally maintaining said driving and driven members in engagement;

a cam means for moving said driving member having a first vertically movable collar and a second rotatably movable collar, said vertically movable collar having an upper surface in abutting relationship with said annular ledge of said pinion, said rotatably movable collar having a first abutment means for rotating said second collar to cause separation of said first and second collars to raise said pinion and disengage said jaw clutch, and having a second abutment means for rotating said second collar in an opposite direction to lower said pinion and engage said jaw clutch;

a shifter fork having a hole in one end for receiving said eccentric for substantially frictionless movement therewith, said shifter fork being disposed in a plane normal to said agitator and adjacent said main driving gear such that rotation of said main driving gear frictionally shifts said shifter fork into engagement with one of said abutment means on said second cam member, said shifter fork defining at another end thereof a recess which partially surrounds said cam means, said recess terminating in spaced apart first and second tynes, said first tyne engageable with said first abutment means and said second tyne engageable with said second abutment means, said spacing between said first and second tynes being such as to prevent simultaneous engagement of more than one of said tynes with said abutment means; and a control means for controlling said motor, said control causing said motor to rotate in a first direction during an agitate portion of a wash cycle to move said shifter fork in the direction of rotation of said gear such that said first tyne of said shifter fork is moved into engagement with said first abutment means to engage said jaw clutch, and said control means causing said motor to rotate in a second opposite direction during a spin portion of said wash cycle to move said shifter fork in the direction of rotation of said gear such that said second tyne on said shifter fork is moved into engagement with said second abutment means on said second cam member to disengage said jaw clutch.

5. The transmission of claim 4 wherein said biasing means is a coil spring abutting an upper surface of said pinion and surrounding said shaft of said agitator.

6. The transmission of claim 4 wherein said second collar has a wall member extending circumferentially from said first abutment means to said second abutment means to prevent contact between said first collar and said tynes.

7. A transmission for a vertical axis washing machine having a washing tub, an agitator within said tub, and a reversible motor for driving said agitator, said transmission interconnected between said agitator and said motor and comprising:

a transmission housing;

a drive shaft connected to said motor journaled for rotation in either direction in said housing;

a worm integrally formed on an end of said drive shaft in said housing;

a jack shaft vertically mounted in said housing and parallel to said agitator;

a drive gear rotatably mounted on said jack shaft and engageable at a lower surface thereof with said worm on said drive shaft;

an eccentric integrally formed on an upper surface of said drive gear;

a pinion gear rotatably mounted on a shaft co-rotational with said agitator;

said pinion gear having a plurality of teeth extending radially outwardly around approximately one-half of a circumference thereof, said pinion gear further having a first set of downwardly extending jaw clutch teeth carried on a lower portion thereof, said jaw clutch teeth having an outer circular periphery which is smaller than a circumference of said pinion gear whereby an annular ledge is formed on a lower surface of said pinion gear which is normal to said agitator;

a reciprocable rack member positioned within said housing normal to said agitator and which has a first portion encircling said eccentric in a sliding relationship therewith and a second portion encircling said pinion, said second portion having a plurality of teeth engaging said radial teeth on said pinion and a flat surface opposite said teeth which is maintained in abutment with a portion of said circumference of said pinion gear having no teeth thereon insuring that continuous engagement of said teeth on said second portion of said reciprocable member will be maintained in engagement with said teeth on said pinion gear, whereby rotation of said eccentric on said drive gear reciprocates said reciprocable member in a plane normal to said agitator such that said teeth on said reciprocable member engage the teeth on said pinion gear;

a lower clutch member co-rotatable with said shaft of said agitator having a second set of clutch teeth mounted on an upper surface thereof, said teeth being engageable with said first set of clutch teeth on said pinion gear such that said reciprocating motion of said pinion gear is transferred to said lower clutch member;

a bias means maintaining said pinion gear normally in engagement with said lower clutch member;

an upper collar member having an upper surface in abutting relationship with said annular ledge of said pinion gear and slidably mounted co-axially on said shaft of said agitator and having a plurality of downwardly sloping ramp surfaces;

anchoring means for maintaining said first collar member stationary with respect to rotation of said agitator shaft but allowing limited vertical movement thereof;

a second collar member mounted slidably co-axially with said shaft of said agitator and having a plurality of upwardly extending ramp surfaces engageable with said downwardly extending ramp surfaces of said first collar member, said second collar member having first and second upwardly extending abutment surfaces integrally formed on an exterior thereof;

a shifter fork disposed in a plane parallel to said reciprocable rack member and having one end connected to said eccentric for movement therewith and in frictional engagement with said main driving gear, said shifter fork having a recess at another end thereof terminating in first and second downwardly extending tynes, said recess of said shifter fork partially surrounding said second cam member such that one of said tynes is in abutment with a corresponding abutment surface on said cam member, such that rotation of said eccentric in a first direction causes rotation of said second collar member in said first direction to engage said ramp surfaces of said first and second collar members, and rotation of said eccentric in a second opposite direction causes abutment of the other of said tynes against the other abutment surface of said second cam to rotate said second collar in an opposite second direction to disengage said surfaces of said first and second collar members.

8. The transmission of claim 7 wherein said anchoring means is a loop integrally formed on an exterior of said first cam member having a vertical bore and a stud extending through said bore and immovably mounted in said housing.

9. In an automatic laundry appliance having a reversible rotary drive means, eccentric means for translating rotary motion of said drive means into oscillatory motion, and a clutch means, having a fixed element and a moveable element, for translating said oscillatory motion to an agitation means extending into a wash tub, a shifter means for said clutch comprising:

means disposed between said fixed and moveable elements operable to cause engagement and disengagement of said clutch means; and an eccentrically rotated control element mounted on said eccentric means which is moveable in a plane normal to said agitation means in response to a change in direction of rotation of said reversible rotary drive means to operate said means to cause engagement and disengagement of said clutch means when a change in direction of rotation of said rotary drive means occurs.

* * * * *

UNITED STATES PATENT AND TRADEMARK OFFICE

CERTIFICATE OF CORRECTION

PATENT NO. : 4,291,556

DATED : September 29, 1981

INVENTOR(S) : ANTHONY MASON

It is certified that error appears in the above—identified patent and that said Letters Patent is hereby corrected as shown below:

Column 6, claim 1, line 14, after "transmitting" change "and" to --said--.

Signed and Sealed this

*Twenty-ninth* Day of *December 1981*

[SEAL]

*Attest:*

GERALD J. MOSSINGHOFF

*Attesting Officer*

*Commissioner of Patents and Trademarks*